US012458182B2

(12) United States Patent
Dempsey

(10) Patent No.: US 12,458,182 B2
(45) Date of Patent: Nov. 4, 2025

(54) ROLLED CENTER DISPENSE PAPER TOWELS PROVIDED IN A NON-CIRCULAR DISPENSER

(71) Applicant: KCooper Brands, Inc., Aurora, CO (US)

(72) Inventor: George W. Dempsey, Aurora, CO (US)

(73) Assignee: KCOOPER BRANDS, INC., Aurora, CO (US)

( * ) Notice: Subject to any disclaimer, the term of this patent is extended or adjusted under 35 U.S.C. 154(b) by 0 days.

(21) Appl. No.: 17/938,093

(22) Filed: Oct. 5, 2022

(65) Prior Publication Data

US 2024/0115085 A1 Apr. 11, 2024

(51) Int. Cl.

| | |
|---|---|
| ***B65H 18/00*** | (2006.01) |
| ***A47K 10/38*** | (2006.01) |
| *A47K 10/32* | (2006.01) |

(52) U.S. Cl.

CPC ..... *A47K 10/38* (2013.01); *A47K 2010/3206* (2013.01); *A47K 2010/3266* (2013.01); *B65H 18/00* (2013.01)

(58) Field of Classification Search

CPC ..... A47K 10/38

See application file for complete search history.

(56) References Cited

U.S. PATENT DOCUMENTS

| | | | | |
|---|---|---|---|---|
| 5,480,060 | A * | 1/1996 | Blythe | A47K 10/421 221/45 |
| 6,447,864 | B2 * | 9/2002 | Johnson | A47K 10/16 221/33 |
| 2010/0168685 | A1 * | 7/2010 | Drown | A61K 31/19 604/289 |
| 2013/0313279 | A1 * | 11/2013 | Sudworth | B65D 75/585 221/45 |
| 2015/0250364 | A1 * | 9/2015 | Yamada | A47K 10/42 248/311.2 |

* cited by examiner

*Primary Examiner* — Gene O Crawford
*Assistant Examiner* — Ayodeji T Ojofeitimi
(74) *Attorney, Agent, or Firm* — Armstrong Teasdale LLP

(57) ABSTRACT

The present application describes a roll of paper products that may be compressed and subsequently provided in a non-circular dispenser. The roll of paper products is coreless, rolled with a specific tension and has a specific center diameter so as to enable individual paper products to be dispensed from the center of the roll even when compressed.

20 Claims, 4 Drawing Sheets

ROLLED CENTER DISPENSE PAPER TOWELS PROVIDED IN A NON-CIRCULAR DISPENSER

BACKGROUND

Various paper products, such as, for example, paper towels, moist towelettes and the like, are typically dispensed from a dispenser. The shape of the dispenser typically matches the shape of the paper product to be dispensed. For example, a continuous roll of paper towels is typically dispensed from a round or circular dispenser. In another example, paper towels may be pre-cut, folded and stacked and dispensed from a rectangular or square dispenser.

In some cases, a rectangular or square dispenser may be preferred over a round dispenser. However, it is time consuming and costly to pre-cut and fold paper products versus rolling the paper products.

SUMMARY

The present application describes a process for preparing a roll (e.g., round/circular) of paper products to be dispensed from a rectangular dispenser, being non-circular or non-square. In an example, the paper products are paper towels that form a continuous roll. Each paper towel in the roll of paper towels may be separated from an adjacent paper towel by a plurality of perforations. The paper towels may be dry paper towels or wet/moistened paper towels/wipes. In an example, the roll of paper towels is coreless (e.g., is not wrapped around a center dowel or core). As such, each paper towel may be dispensed from the center.

As will be explained in detail below, the paper towels are rolled at a specific tension and rolled to define a coreless center from which the paper towels are dispensed. The coreless center has a particular size that enables the roll of paper towels to be compressed so as to fit in a rectangular dispenser. The tension, in combination with the diameter of the coreless center, enables the roll of paper towels to be compressed while still enabling the paper towels to be center dispensed.

Accordingly, the present application describes a paper product that includes a continuous sheet being separable by a plurality of perforations. In an example, the continuous sheet of the paper product is rolled such that the roll of paper products is coreless, is rolled at a tension between approximately four pounds to approximately six pounds and has a center diameter of between approximately one and a half inches to approximately four inches.

The present application also describes a method, that includes rolling a continuous sheet of a paper product into a coreless roll. The coreless roll is rolled with a roll tension of between approximately four pounds to approximately six pounds. Additionally, a center diameter of the coreless roll is between approximately one and a half inches to approximately four inches. The coreless roll is compressed to fit within a non-circular dispenser. The compressed roll is then placed within the non-circular dispenser.

Also described is a paper product and dispenser. The paper product and dispenser includes a continuous sheet of the paper product being rolled to a substantially round shape. The roll is coreless and has a center diameter of between approximately one and a half inches to approximately four inches. In an example, the continuous sheet of the paper product is rolled at a tension between approximately four pounds to approximately six pounds and subsequently compressed. A rectangular dispenser receives the compressed continuous sheet of the paper product.

BRIEF DESCRIPTION OF THE DRAWINGS

Non-limiting and non-exhaustive examples are described with reference to the following Figures.

DETAILED DESCRIPTION

In the following detailed description, references are made to the accompanying drawings that form a part hereof, and in which are shown by way of illustrations, specific embodiments or examples. These aspects may be combined, other aspects may be utilized, and structural changes may be made without departing from the present disclosure. The following detailed description is therefore not to be taken in a limiting sense, and the scope of the present disclosure is defined by the appended claims and their equivalents.

As outlined above, paper products such as, for example, paper towels, moist towelettes and the like, are typically dispensed from a dispenser. The shape of the dispenser typically matches the shape of the paper product to be dispensed. For example, a continuous roll of paper towels is typically dispensed from a round dispenser. In another example, paper towels may be cut, folded, stacked and dispensed from a rectangular or square dispenser. However, as indicated above, it is time consuming and costly to cut and fold paper products versus rolling the paper products.

Accordingly, the present application describes a center dispense rolled paper product (e.g., dry paper towels) that may be configured to fit within a rectangular dispenser (or non-circular dispenser) that exceeds a diameter of the rolled paper product by more than twenty-five percent. In order to fit within the non-circular dispenser, the center dispense rolled paper product is rolled with a specific tension and with a particular coreless center size. The specific tension and/or the coreless center size enables the center dispense rolled paper product to be compressed and subsequently placed in a non-circular dispenser while still enabling the rolled paper product to be dispensed (e.g., pulled) from the center of the rolled paper product.

In an example, the center dispense rolled paper product described herein are paper towels. However, the features described herein are not limited to paper towels. For example, the features described herein may be used to dispense wet/moistened paper towels/wipes.

These and other features will be described in more detail with respect to FIG. 1A-FIG. 4.

Figure 1A:
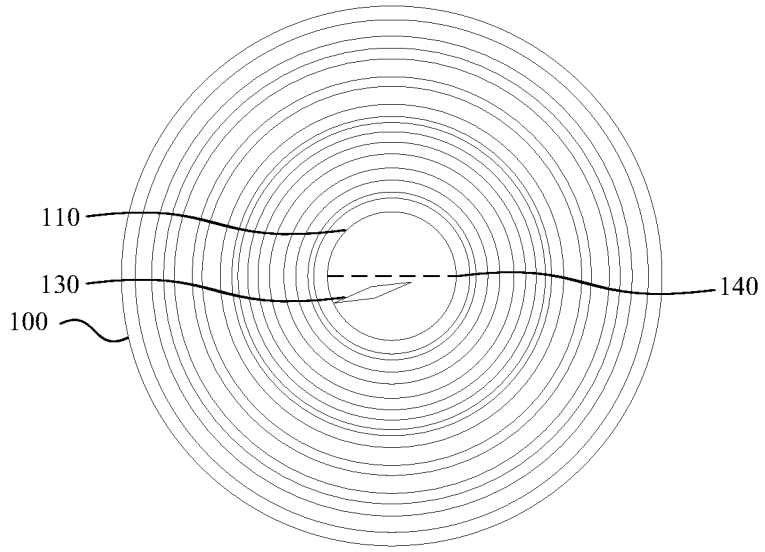
FIG. 1A is a top view of a roll of paper towels according to an example.

FIG. 1A is a top view of a roll of paper towels 100 according to an example. In some examples, the roll of paper towels 100 are dry. In other examples, the roll of paper towels may be wet/moist. In an example, the roll of paper towels may be made from different materials and/or have different qualities, grades and/or gauges. For example, the roll of paper towels may be DRC (e.g., pulp with a binder). In another example, the roll of paper towels maybe be a thin layer of plastic with pulp or rayon fibers. In yet another example, the roll of paper towels is a rolled fabric made of either natural fibers or combined with films or threads of plastic. The roll of paper towels maybe 8×12" or 10×14" but other sizes may be used.

In the example shown in FIG. 1A, the roll of paper towels 100 is coreless or is otherwise configured to dispense paper towels from the center 110 of the roll of paper towels 100. For example and as shown in FIG. 1A, an edge or side of one paper towel 130 may extend from the center 110 of the roll of paper towels 100. As such, an individual may grab the edge of the paper towel 130 and pull outward/upward to remove the paper towel 130 from the center of the roll of paper towels 100.

Figure 1B:
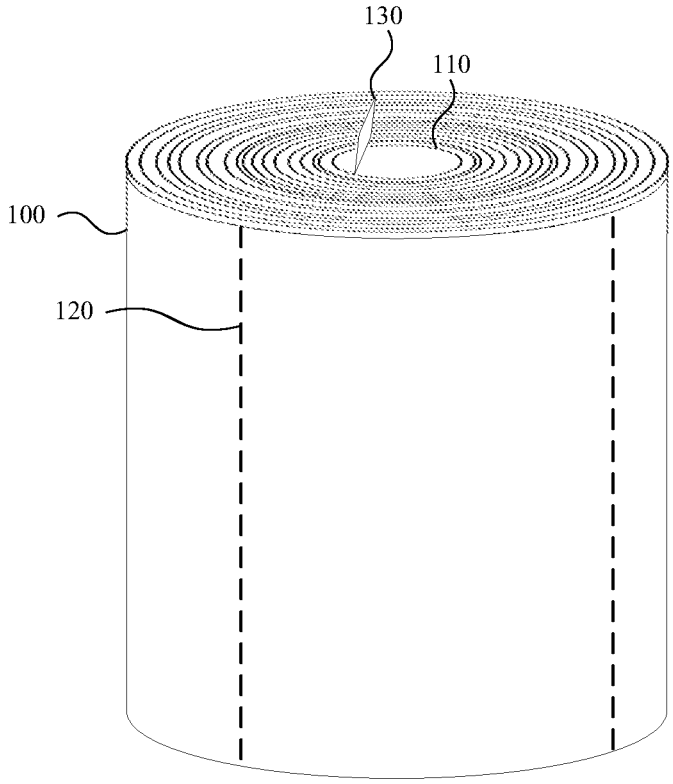
FIG. 1B is a perspective view of the roll of paper towels shown and described with respect to FIG. 1A according to an example.

In an example, the roll of paper towels 100 is a continuous roll. As such, an individual may tear a length of paper towel 130 from the roll of paper towels 100. In another example and as shown in FIG. 1B, the roll of paper towels 100 includes a plurality of perforations 120 that enable the paper towel 130 in the roll of paper towels 100 to be separated from an adjacent paper towel.

During a manufacturing process, the roll of paper towels 100 is rolled such that the roll of paper towels 100 is round or substantially round. As indicated above, rolling the roll of paper towels 100 in this manner reduces manufacturing time and cost when compared with other methods of preparing paper towels to be provided in a dispenser (e.g., folding and/or cutting). As indicated above, the roll of paper towels is coreless. As also indicated above, after the manufacturing process, the roll of paper towels 100 is subsequently be compressed which enables the roll of paper towels 100 to be provided in a non-circular dispenser.

In order to accomplish the above, the roll paper towels 100 is rolled at a specific tension and with a particular coreless center size. This allows the paper towels to be compressed so as to fit within a non-circular dispenser. In an example, the roll of paper towels 100 is rolled with a tension between approximately four pounds to approximately six pounds. If the tension is too tight, the roll of paper towels will not be able to be compressed and subsequently placed in the non-circular dispenser. However, if roll of paper towels is too loose, a desired number of paper towels may not be included in the roll of paper towels. In addition to the tension of the roll of paper towels 100, the size (e.g., diameter 140) of the center 110 is between approximately one and half inches to approximately four inches. The roll tension, along with the size the center 110 enables the roll of paper towels 100 to be compressed and placed in a non-circular dispenser while still allowing a paper towel 130 to be dispensed from the center 110 of the roll of paper towels 100.

Although specific roll tensions and sizes of the center 110 have been discussed, these may change based, at least in part, on the gauge of the paper towels, whether the paper towels are dry or wet, etc.

Figure 2A:
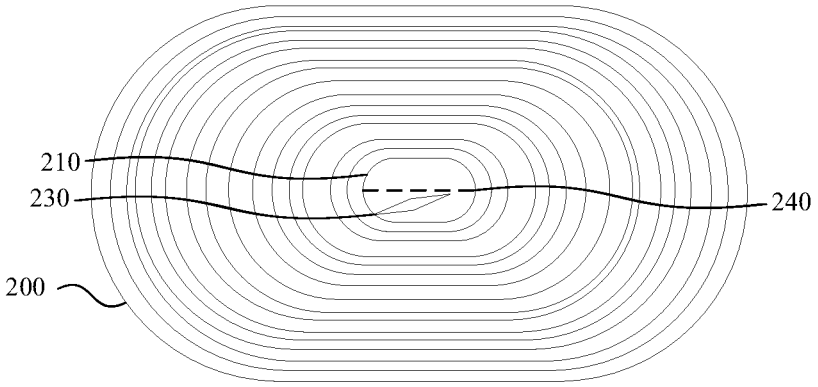
FIG. 2A is a top view of a roll of paper towels that have been compressed according to an example.
Figure 2B:
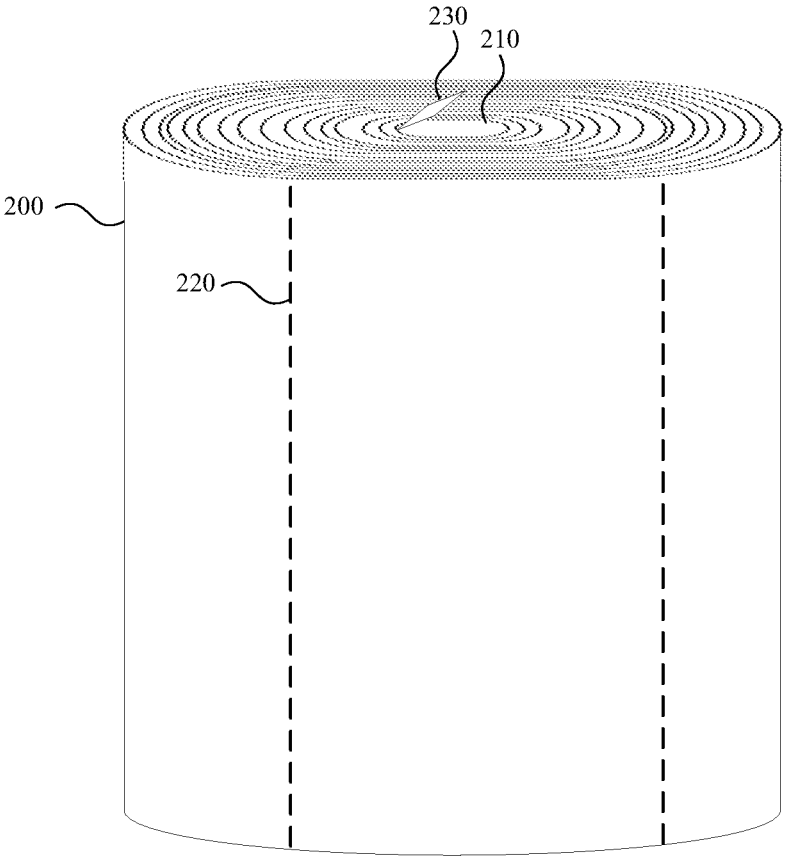
FIG. 2B is a perspective view of the compressed roll of paper towels shown and described with respect to FIG. 2A according to an example.

FIG. 2A is a top view of a roll of paper towels 200 that has been compressed according to an example and FIG. 2B is a perspective view of the compressed roll of paper towels 200 shown and described with respect to FIG. 2A according to an example.

The roll of paper towels 200 may be similar to the roll of paper towels 100 shown and described with respect to FIG. 1A-FIG. 1B. For example, the roll of paper towels 200 may have perforations 220 that enable adjacent paper towels to be separated from each other. Likewise, a single paper towel 230 may be dispensed from the center 210. As discussed above, the tension at which the roll of paper towels 200 was originally rolled, along with the size (e.g., diameter 240) of the center 210 enables the paper towel 230 to be center dispensed—even after the roll of paper towels 200 has been compressed.

In an example, the roll of paper towels 200 may be compressed by hand and subsequently placed in a dispenser. In another example, the roll of paper towels 200 may be compressed by a machine and subsequently placed in a dispenser.

In an example, the compression process causes the center 210 of the roll of paper towels 200 to elongate such as shown in FIG. 2A and FIG. 2B (when compared to the center 110 of the roll of paper towels 100 shown in FIG. 1A). The compression process allows the roll of paper towels 200 to be provided in a rectangular (or other non-circular) dispenser such as shown in FIG. 3 while still enabling a single paper towel 230 (or multiple paper towels) to be dispensed from the center 210 of the roll of paper towels 200.

When the roll of paper towels 200 is compressed, the shape of the roll of paper towels 200 may change from substantially round/circular to substantially oblong so as to fit within a rectangular dispenser. In an example, the diameter 240 of the of the center 210 of the roll of paper towels 200 may elongate by at least twenty-five percent. The elongation of the center 210 enables the paper towels to be dispensed from the center even when the roll of paper towels 200 has been compressed.

Figure 3:
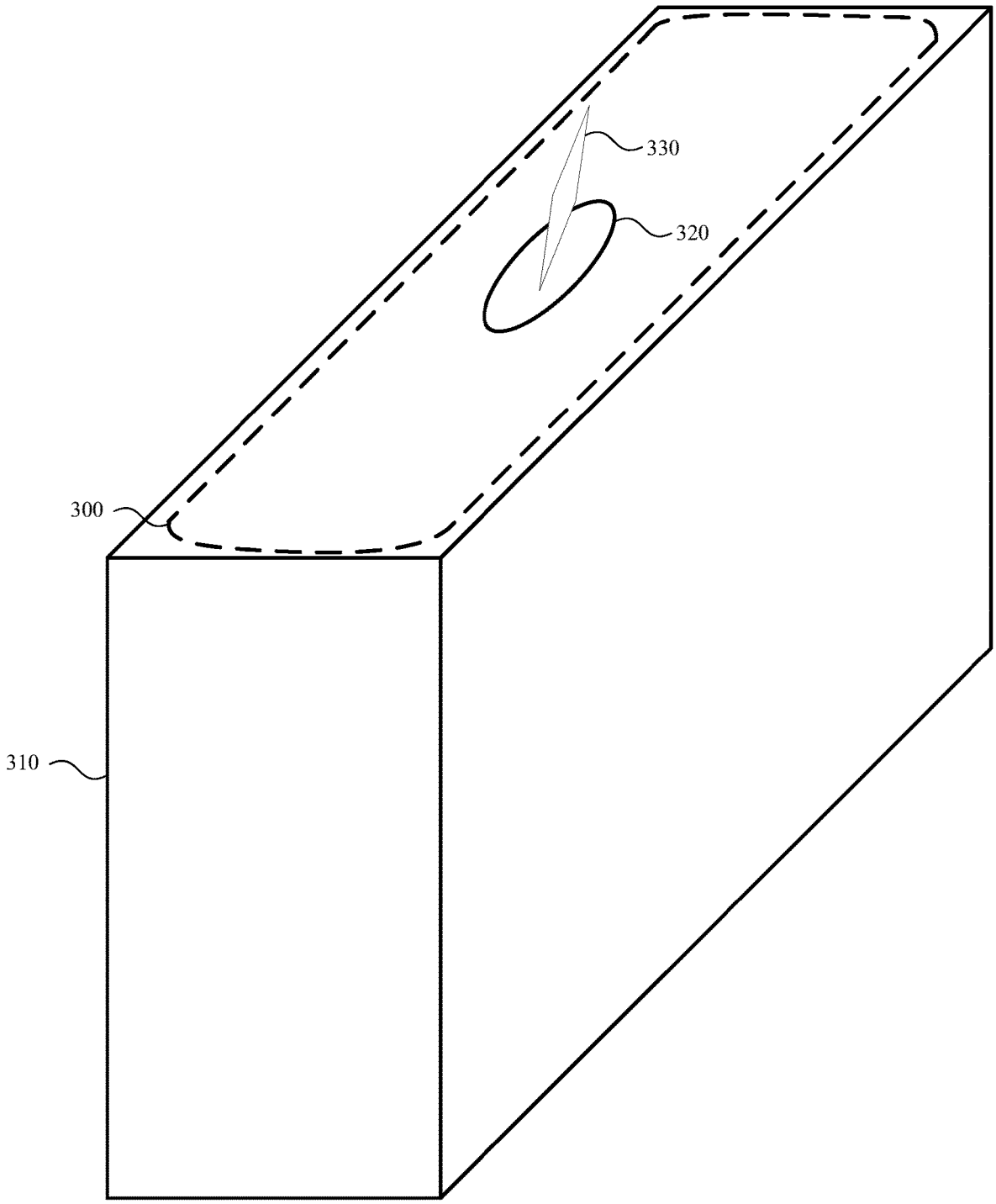
FIG. 3 illustrates a compressed roll of paper towels being disposed in a rectangular dispenser according to an example.

FIG. 3 illustrates a compressed roll of paper towels 300 being disposed in a rectangular dispenser 310 according to an example. In an example, the roll of paper towels 300 may be similar to the roll of paper towels 200 shown and described with respect to FIG. 2A-FIG. 2B.

As shown in FIG. 3, the roll of paper towels 300 has been compressed and placed in a rectangular (or non-circular/non-square) dispenser 310. In an example, the dispenser 310 may be 4.5"×9"×8 although other dimensions may be used.

The dispenser 310 may be made of cardboard, chip board, plastic or other suitable material. The dispenser 310 may define an opening 320 through which one or more paper towels 330 from the roll of paper towels 300 may be dispensed. Although a single opening 320 is shown and described, the dispenser 310 may define any number of openings though which paper towels 330 may be dispensed. Additionally, the opening 320 may be defined at any location on the dispenser 310. In some examples, the opening 320 may have any shape. Additionally, the opening 320 may have a lid or cap that enables the opening to be closed when paper towels 330 are not being dispensed from the dispenser 310.

Figure 4:
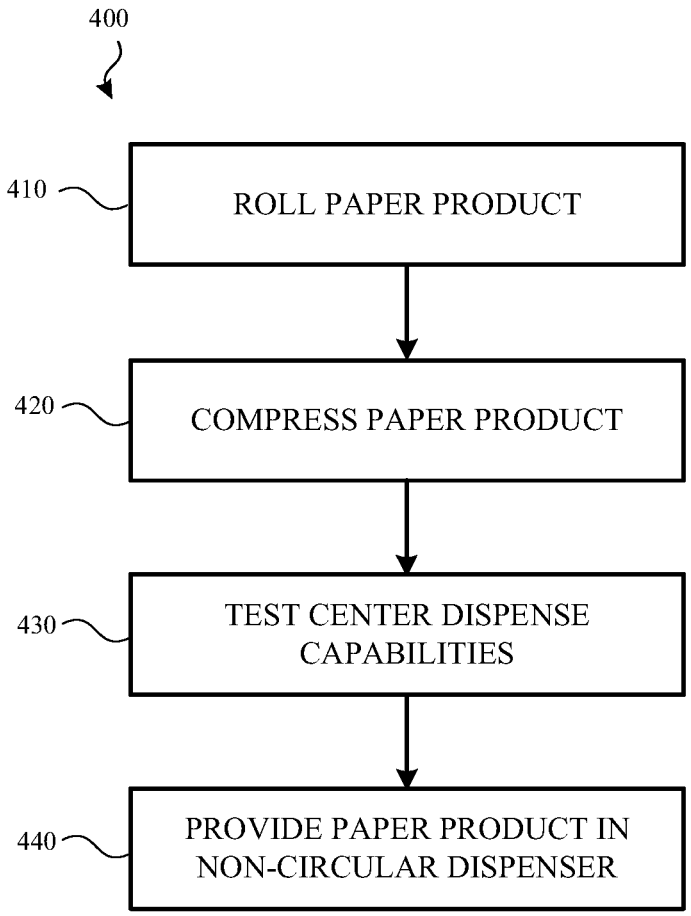
FIG. 4 illustrates a method for providing a paper product in a non-circular dispenser according to an example.

FIG. 4 illustrates a method 400 for providing a paper product in a non-circular dispenser according to an example. The paper product may be a roll of paper towels such as described above with respect to FIG. 1A-FIG. 2B.

The method 400 begins when a paper product is rolled (410). Rolling may include rolling a continuous sheet of paper products into a round/circular shape or substantially round/circular shape. In another example, the paper products may be folded and subsequently rolled into a round/circular shape or substantially round/circular shape. The roll of paper products may be dry or wet such as described above.

In an example, the paper product may be rolled with a tension between approximately four pounds to approximately six pounds. Although a specific rolled tension is mentioned, other tensions may be used. In addition to the tension, the paper product is coreless. However, the paper product may be rolled such that a diameter of a center roll of paper products is between approximately one and a half inches to approximately four inches.

Once the paper product has been rolled, the paper product is compressed (420). As explained above, the compression causes the center of the roll of paper products to elongate. Once the roll of paper product has been compressed, the roll of paper product may be (optionally) tested (430) or tuffed to determine whether a single paper product (e.g., a single paper towel) can be dispensed from the center of the compressed roll. As discussed above, if the paper product was rolled at the specified tension and with the specified center diameter, the single paper towel will be dispensed from the center, even though the roll of paper products has been compressed. The roll of paper products is then provided (440) in a non-circular dispenser.

The description and illustration of one or more aspects provided in the present disclosure are not intended to limit or restrict the scope of the disclosure in any way. The aspects, examples, and details provided in this disclosure are considered sufficient to convey possession and enable others to make and use the best mode of claimed disclosure.

The claimed disclosure should not be construed as being limited to any aspect, example, or detail provided in this disclosure. Regardless of whether shown and described in combination or separately, the various features (both structural and methodological) are intended to be selectively rearranged, included or omitted to produce examples with a particular set of features. Having been provided with the description and illustration of the present application, one skilled in the art may envision variations, modifications, and alternate aspects falling within the spirit of the broader aspects of the general inventive concept embodied in this application that do not depart from the broader scope of the claimed disclosure.

References to an element herein using a designation such as "first," "second," and so forth does not generally limit the quantity or order of those elements. Rather, these designations may be used as a method of distinguishing between two or more elements or instances of an element. Thus, reference to first and second elements does not mean that only two elements may be used or that the first element precedes the second element. Additionally, unless otherwise stated, a set of elements may include one or more elements.

Terminology in the form of "at least one of A, B, or C" or "A, B, C, or any combination thereof" used in the description or the claims means "A or B or C or any combination of these elements." For example, this terminology may include A, or B, or C, or A and B, or A and C, or A and B and C, or 2A, or 2B, or 2C, or 2A and B, and so on. As an additional example, "at least one of: A, B, or C" is intended to cover A, B, C, A-B, A-C, B-C, and A-B-C, as well as multiples of the same members. Likewise, "at least one of: A, B, and C" is intended to cover A, B, C, A-B, A-C, B-C, and A-B-C, as well as multiples of the same members.

Similarly, as used herein, a phrase referring to a list of items linked with "and/or" refers to any combination of the items. As an example, "A and/or B" is intended to cover A alone, B alone, or A and B together. As another example, "A, B and/or C" is intended to cover A alone, B alone, C alone, A and B together, A and C together, B and C together, or A, B, and C together.

What is claimed is:

1. A fabric product, comprising:

a continuous sheet of the fabric product being separable by a plurality of perforations, the continuous sheet of the fabric product being rolled such that the roll:

is coreless;

is rolled at a tension in a range from four pounds to six pounds; and has a center diameter in a range from one and a half inches to less than four inches, wherein the tension and the center diameter enable the roll to be compressed and enable a single fabric paper to be disposed from the center of the roll when compressed.

2. The fabric product of claim 1, wherein the continuous sheet of the fabric product is folded prior to being rolled.

3. The fabric product of claim 1, wherein the fabric product is a wet fabric product.

4. The fabric product of claim 1, wherein the fabric product is a dry fabric product.

5. The fabric product of claim 1, wherein the compressed rolled fabric product is provided in a non-circular dispenser.

6. The fabric product of claim 1, wherein compressing the rolled fabric product causes the roll to change from a circular shape to an oblong shape.

7. The fabric product of claim 1, wherein the fabric product is non-woven.

8. A method, comprising:

rolling a continuous sheet of a fabric product into a coreless roll with a roll tension in a range of four pounds to six pounds such that a center diameter of the coreless roll is less than four inches;

compressing the coreless roll to fit within a non-circular dispenser;

placing the compressed andcoreless roll within the non-circular dispenser; and dispensing at least one sheet of the continuous sheet of the fabric product from the center diameter of the compressed and coreless roll, wherein at least one of the roll tension and the center diameter enables the at least one sheet to be dispensed from the center diameter of the compressed and coreless roll.

9. The method of claim 8, wherein the non-circular dispenser is rectangular.

10. The method of claim 8, wherein compressing the coreless roll causes the coreless roll to have an oblong shape.

11. The method of claim 8, further comprising folding at least a portion of the continuous sheet of the fabric product prior to the rolling.

12. The method of claim 8, wherein compressing the roll causes the center diameter to elongate by at least twenty-five percent.

13. The method of claim 8, wherein the continuous sheet of the fabric product is non-woven.

14. A fabric product and dispenser, comprising:

a continuous sheet of the fabric product being rolled to a substantially round shape, the roll being coreless and having a center diameter greater than one and a half inches and less than four inches, the continuous sheet of the fabric product being rolled at a tension in a range of four pounds to six pounds and subsequently compressed, wherein at least one of the tension and center diameter enables the roll to be compressed and enable a single sheet of the fabric product to be dispensed from the center diameter when the roll is compressed; and a rectangular dispenser that receives the compressed continuous sheet of the fabric product.

15. The fabric product and dispenser of claim 14, wherein the continuous sheet of the fabric product is folded prior to being rolled.

16. The fabric product and dispenser of claim 14, wherein the fabric product is a wet fabric product.

17. The fabric product and dispenser of claim 14, wherein compressing the continuous sheet of the fabric product causes the center diameter to elongate by at least twenty-five percent.

18. The fabric product and dispenser of claim 14, wherein the compressed continuous sheet of the fabric product has an oblong shape.

19. The fabric product and dispenser of claim 14, further comprising a plurality of perforations on the continuous sheet of the fabric product.

20. The fabric product and dispenser of claim 14, wherein the continuous sheet of the fabric product is non-woven.

* * * * *